US005201090A

United States Patent [19]

Jans

[11] Patent Number: 5,201,090

[45] Date of Patent: Apr. 13, 1993

[54] APPARATUS FOR CLEANING THE INSULATORS OF LIVE POWER LINES BY MEANS OF HELICOPTER

[76] Inventor: Donato Jans, Via Circonvallazione 17, 11026 Pont Saint Martin (Prov. of Aosta), Italy

[21] Appl. No.: 765,731

[22] Filed: Sep. 26, 1991

[30] Foreign Application Priority Data

Oct. 4, 1990 [IT] Italy ..... 67759 A/90

[51] Int. Cl.[5] ..... A46B 13/02

[52] U.S. Cl. ..... 15/88.4; 15/21.1; 15/88

[58] Field of Search ..... 15/21.1, 88.4, 88, 97.1

[56] References Cited

U.S. PATENT DOCUMENTS 3,457,574 7/1969 Hirt ..... 15/88.4

5,001,801 3/1991 Jarvis et al. ..... 15/88

FOREIGN PATENT DOCUMENTS 3508769 9/1986 Fed. Rep. of Germany ..... 15/21.1

*Primary Examiner*—Edward L. Roberts

*Attorney, Agent, or Firm*—Guido Modiano; Albert Josif

[57] ABSTRACT

The apparatus has an operating structure which is suspendable, by means of cables, from the barycentric hook of a helicopter and is provided with an orientatable arm having a cleaning head rigidly associated therewith. The cleaning head is provided with supports for suspending rotating cleaning brushes actuated by motors. Part of the suspension support is fixed and is constituted by a frame connected to the orientatable arm, and a movable support is supported by the frame so as to be oscillatable and is controlled by motors which allow to move the related brush or brushes from an open approach position to a closed operative position in which the set of brushes of the head embraces the set of insulators.

18 Claims, 5 Drawing Sheets

APPARATUS FOR CLEANING THE INSULATORS OF LIVE POWER LINES BY MEANS OF HELICOPTER

BACKGROUND OF THE INVENTION

The present invention relates to an apparatus for cleaning the insulators of live power lines by means of helicopters.

As known, deposits of dust and electrically conducting particles form on the insulators of high-voltage power lines, also due to the electrostatic fields, and can compromise the insulating power of the ceramic material or glass of said insulators and trigger discharge arcs which damage the line and the pylons which support it until the supply of power is interrupted.

This phenomenon, which becomes more frequent as the voltage of the line rises and as the content of particles, suspended corpuscles and sea-salt in the atmosphere increases, necessitates periodic removal of said deposits from the insulators, especially in the regions of connection between one insulator and another, where discharge arcs are triggered more easily.

These maintenance operations are currently performed manually by specialized personnel after disconnecting the line from the voltage source, and this entails considerable maintenance costs and more importantly the interruption of the delivery of power, with obvious practical disadvantages.

SUMMARY OF THE INVENTION

The aim of the present invention is to eliminate these disadvantages, and an important object is to provide an apparatus which, suspended from the barycentric hook of a hovering helicopter, allows to automatically clean, while the power line is live, sets of insulators arranged in any way, i.e. vertically, horizontally and inclined.

Another important object of the present invention is to provide an apparatus which ensures the total removal of the deposits from the insulators, especially in the usually scarcely accessible regions which connect the adjacent insulators which form each set.

A further important object of the invention is to provide an apparatus which can remove the deposits even in the total absence of liquids, ensuring in any case, and exclusively by virtue of a mechanical action, the removal of the particles which form the deposit. This prerogative of the apparatus is very important, since generally the additive compounds of detergent liquids can be ionized and therefore cannot be used on live lines.

Another object of the present invention is to provide an apparatus which is easy to operate and is fully remotely controllable by the operator, who is the helicopter pilot himself.

In order to achieve this aim, these important objects and others which will become apparent hereinafter from the following detailed description, the present invention provides an apparatus for cleaning the insulators of live power lines by means of helicopters, characterized in that it comprises an operating structure which is suspendable from the barycentric hook of a helicopter and is provided with an orientatable arm, at the end of which a cleaning head is rigidly associated, said cleaning head comprising support means for suspending rotating cleaning brushes actuated by motor means; and in that part of said suspension support means is fixed and connected to the orientatable arm and another part is movable and supported by the fixed supports so as to be oscillatable and is controlled by means for controlled movement; said operating structure being positionable on a set of insulators by virtue of the opening of the movable supports of the cleaning head, said movable supports being closed, after approach, so as to move all of the brushes into contact engagement with said set of insulators.

According to an embodiment of the invention, the brushes ar formed by stacked disk-like layers of bristles made of synthetic material which are suitable for penetrating in the spaces comprised between two contiguous insulators. Said brushes are carried by respective fork-shaped supports, the axes whereof are substantially parallel to the axis of the set of insulators but slightly mutually converge; when the brushes embrace the set of insulators, this inclination produces an axial thrust component which causes the translatory motion of the operating structure along said set.

According to another embodiment of the invention, suitable for higher-voltage lines with large insulators provided with protruding ridges, the brushes are supported in a cantilever manner and in adjacent rows, with the related rotation axis orthogonal to the axis of the set of insulators; each brush is suitable for entering, with its free end, the spaces comprised between the adjacent insulators.

Said brushes, which have small dimensions, extend radially from a supporting frame which has a substantially polygonal plan and has a fixed portion, which is connected to the orientatable arm, and at least one movable portion, which is articulated to the fixed portion: said fixed and movable portions support corresponding series of rotating brushes, means being provided for moving the movable portions with respect to the fixed portion and for causing the operating structure to assume an open approach configuration and a closed operating configuration.

BRIEF DESCRIPTION OF THE DRAWINGS

Further characteristics, objects and advantages of the invention will become apparent from the following detailed description and with reference to the accompanying drawings, given only by way of non-limitative example, wherein.

DESCRIPTION OF THE PREFERRED EMBODIMENTS

Figure 1:
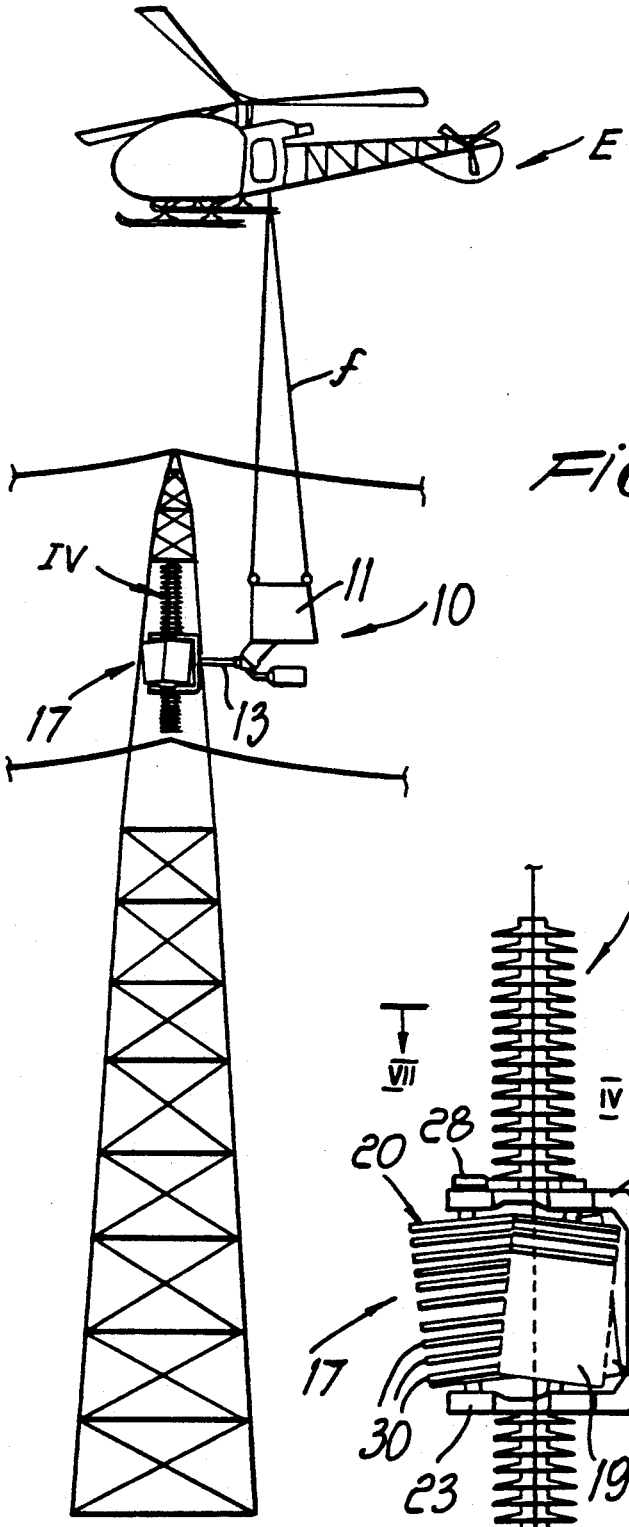
FIG. 1 is an elevation view of the apparatus, illustrating the method of use thereof, suspended from a hovering helicopter.
Figure 2:
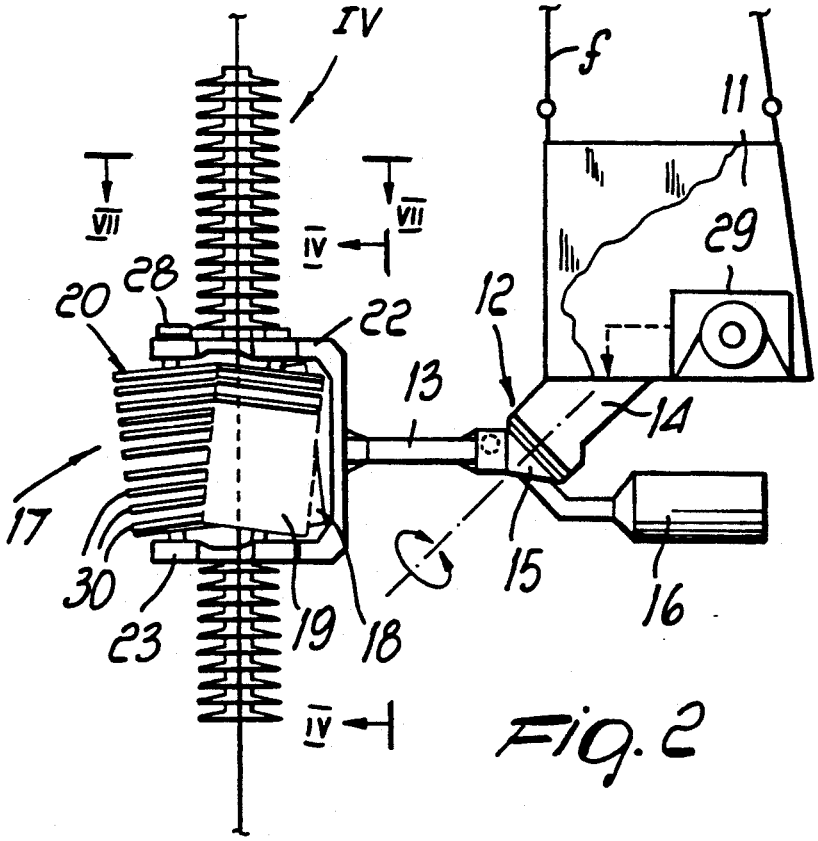
FIG. 2 is a schematic enlarged-scale lateral elevation view exclusively of the apparatus, preset for operating on a vertical set of insulators.
Figure 3:
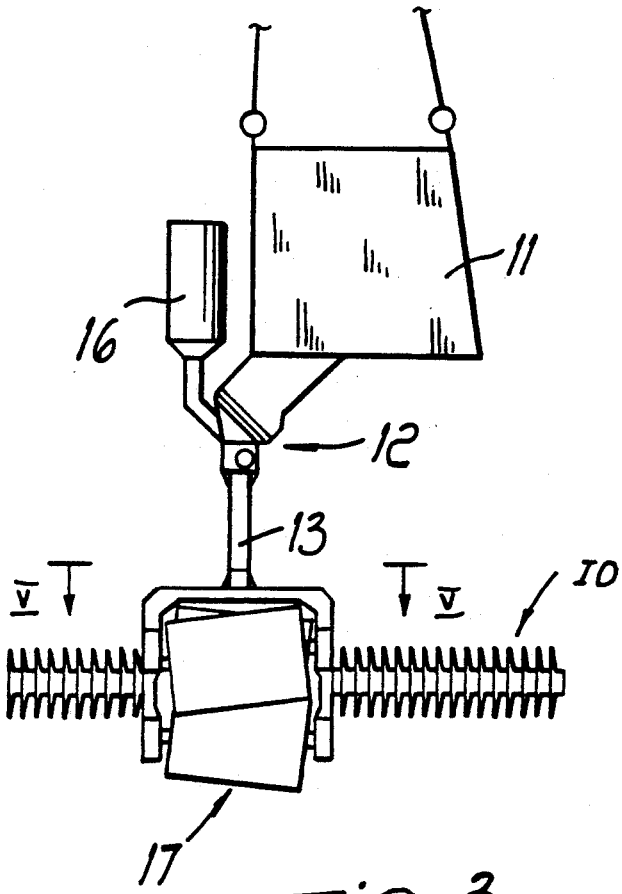
FIG. 3 is a view, similar to FIG. 2, of the apparatus operating on a horizontal set of insulators.
Figure 4:
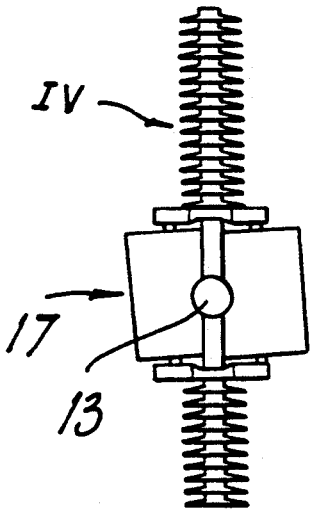
FIG. 4 is a sectional view taken along the line IV—IV of FIG. 2.
Figure 5:
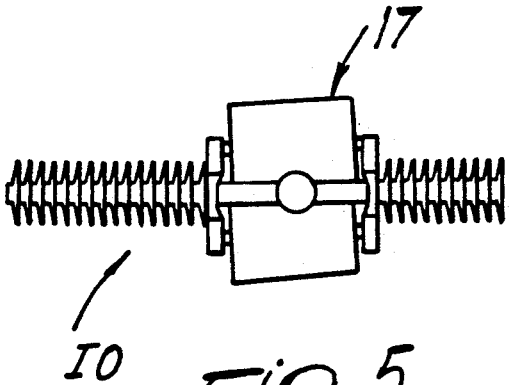
FIG. 5 is a sectional view taken along the line V—V of FIG. 3.

Initially with reference to FIGS. 1 to 8, the reference numeral 10 generally indicates, an apparatus suitable for cleaning insulators medium- and low-voltage lines, which comprises an operating structure 11 which, by means of cables "f", is suspended from the barycentric hook of a helicopter "E".

Figure 6:
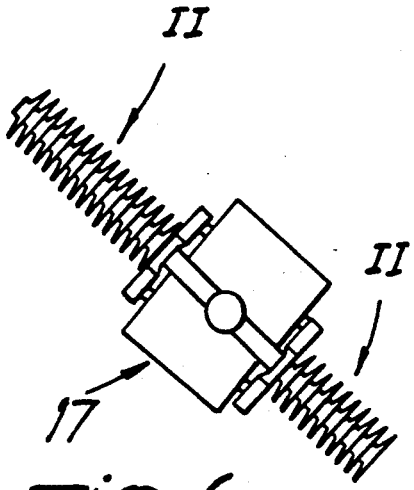
FIG. 6 is a sectional view, similar to FIGS. 4 and 5, of the arrangement of the brushes of the apparatus on an inclined set of insulators.

A hollow orientatable arm 13 is connected to the structure 11 by means of an articulation 12 and can move between two extreme positions, respectively a horizontal position and a vertical position. The two extreme positions correspond to respective operative configurations of the apparatus for cleaning sets of vertical insulators IV (FIG. 2) and of horizontal insulators IO (FIG. 3); the intermediate positions of the arm are suitable for cleaning sets of insulators II which are variously inclined (FIG. 6). For this purpose, the articulation 12 is constituted by a rotational coupling with a base 14 and a turret 15. The base 14 is inclined by 45° with respect to the operating structure 11 which supports it. The turret 15 is rotatably connected to the base and the arm 13 is rigidly associated with the turret 15; said arm 13 is arranged at 45° with respect to the common axis of the turret and of the base.

An electric or fluid-activated motor means, not illustrated, is provided so as to rotate the turret 15 with respect to the base in order to incline the arm parallel to the generatrices of a cone which has an axis which coincides with the rotation axis of the turret and an apex angle of 90°.

For this purpose it is advantageous to use a hydraulic-cylinder actuator coupled to the turret 15 with a rack-and-pinion coupling. A counterweight 16 is connected to the turret 15 on the side opposite to the arm 13 and balances the weight of the arm and of a cleaning head 17 which is carried at the end of said arm. The head 17 comprises at least three brushes 18-19-20, each of which is, supported by a respective fork-shaped suspension support or frame. Two of said supports or frames, respectively indicated by 21 and 22, are rigidly connected to the arm 13 and support, in a conveniently spaced arrangement, the brushes 18 and 19, the relative position whereof is consequently fixed; the brushes are mutually substantially tangent or almost tangent. The third support 23 is oscillatable with respect to the other two, since it is rotationally connected, at 24, to the ends of the support 22. Therefore the third brush 20 can move with respect to the other two and can assume an open configuration, illustrated in FIG. 7, and a closed one, illustrated in FIG. 8. A preferably fluid-activated actuator, for example a jack 25, is provided in order to move the support 23 from one configuration to the other.

Each brush 18-19-20 is rotated by a respective motor means 26-27-28, preferably a compressed-air or hydraulic motor or other fluid-activated motor. A source of pressurized fluid 29, for example a motor-compressor unit in the case of compressed-air motors or a motor-pump unit in the case of hydraulic motors, is accommodated in the structure 11 so as to supply said motors by means of a duct (not illustrated).

Alternatively, the source of pressurized fluid can be placed on the helicopter E and be connected by means of flexible pipes to a distribution valve arranged in the structure 11. It should be noted that if the motors 26-27-28 are pneumatic, the compressed air for supply can be bled from the compressor of the helicopter engine, consequently eliminating the motor-compressor unit.

As clearly illustrated in the figures, the brushes 18, 19 and 20 are supported by the related supports 21-22-23 so that their axes converge slightly toward one another; the inclination of said axes, which is advantageously comprised between four and eight degrees, is suitable for producing an axial thrust component which generates or facilitates the sliding of the set of brushes along the set of insulators.

Each brush is formed by stacked disk-like layers 30 of bristles made of a dielectric material, for example polymeric material, and the distance between two successive layers is chosen so that it is substantially equal to the spacing between the insulators of the set, so that the bristles can penetrate in the grooves defined by the adjacent insulators.

Respective nozzles 31, 32 and 33 are preferably provided on the fork-shaped supports 21, 22 and 23, are supplied by a duct (not illustrated) and are suitable for dispensing a compressed fluid to disperse the particles which the brushes remove from the insulators; said fluid is constituted by compressed air, with the possible addition of non-ionizable detergent compounds conveniently nebulized by the air jet.

Figure 7:
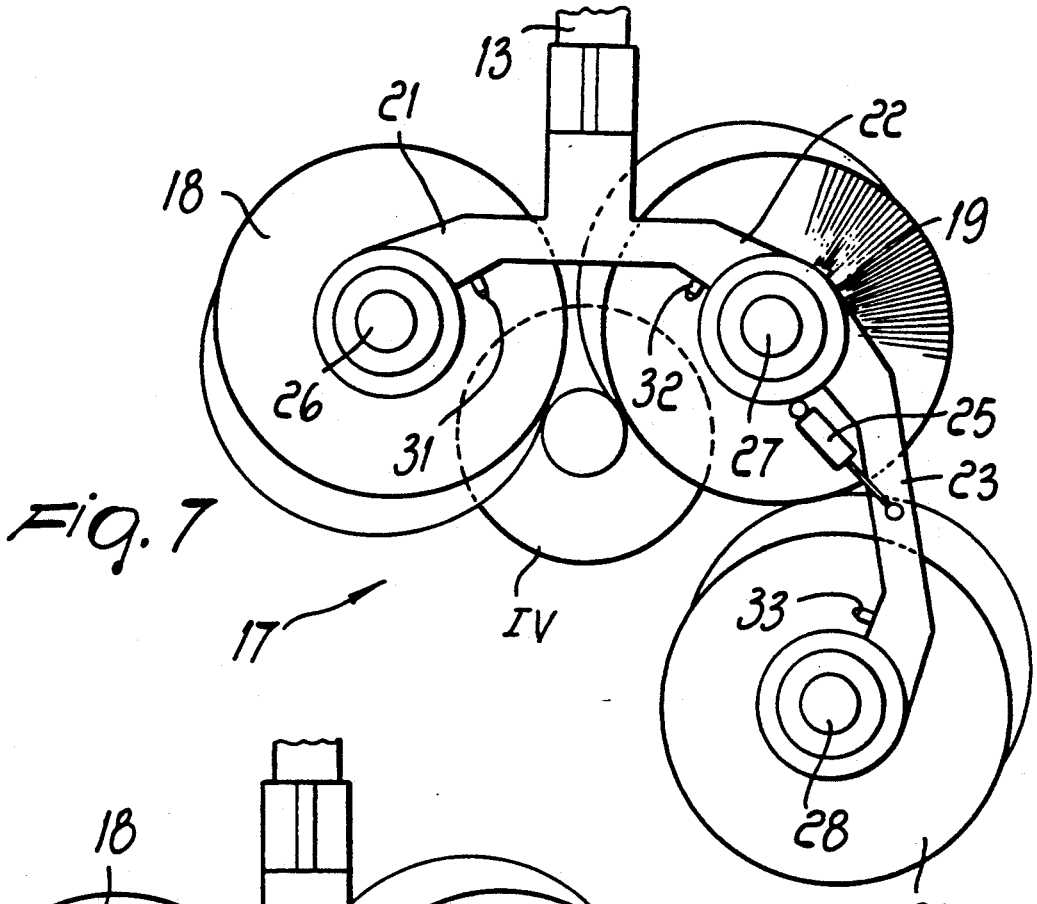
FIG. 7 is an enlarged-scale sectional view, taken along the line VII—VII of FIG. 2, of the brushes in open position.
Figure 8:
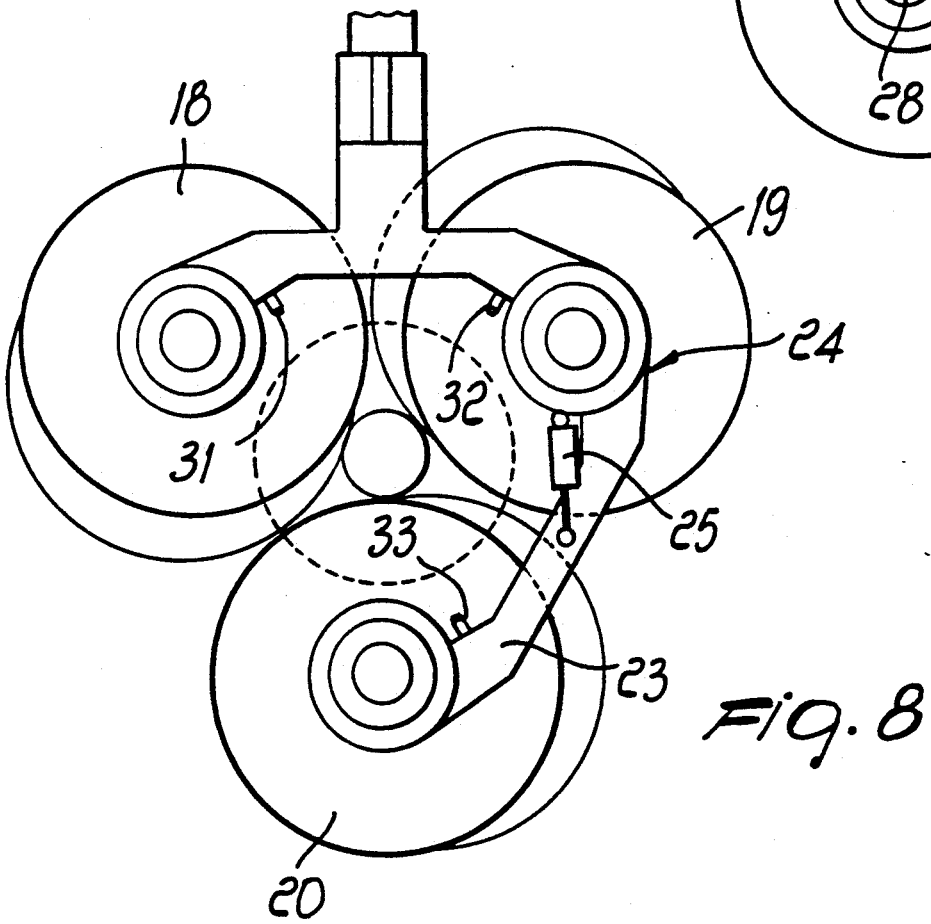
FIG. 8 is a sectional view, similar to FIG. 7, of the brushes in closed position.
Figure 9:
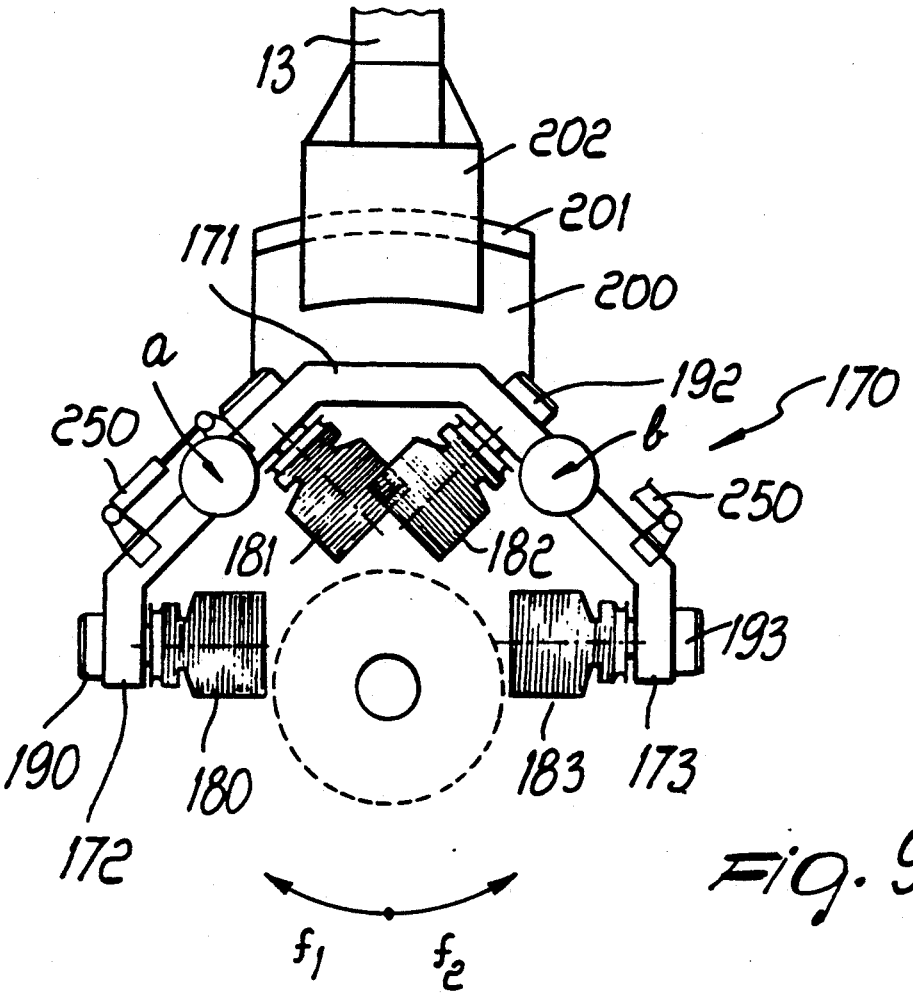
FIG. 9 is a schematic plan view of the cleaning head according to another embodiment of the invention.
Figure 10:
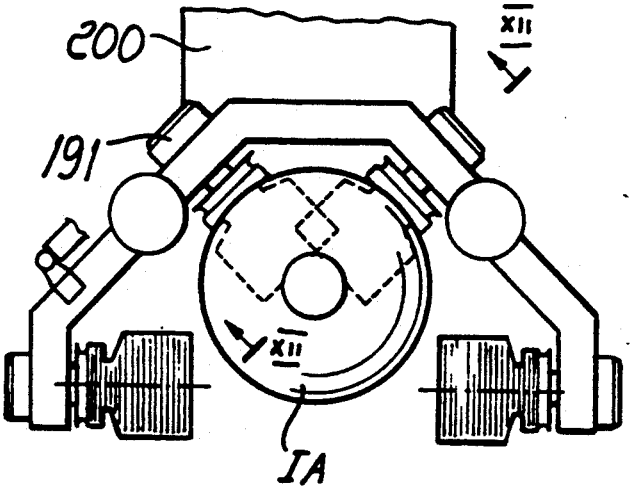
FIGS. 10 and 11 are views, similar to FIG. 9, of the steps of approach and closure of the cleaning head of FIG. 9.
Figure 11:
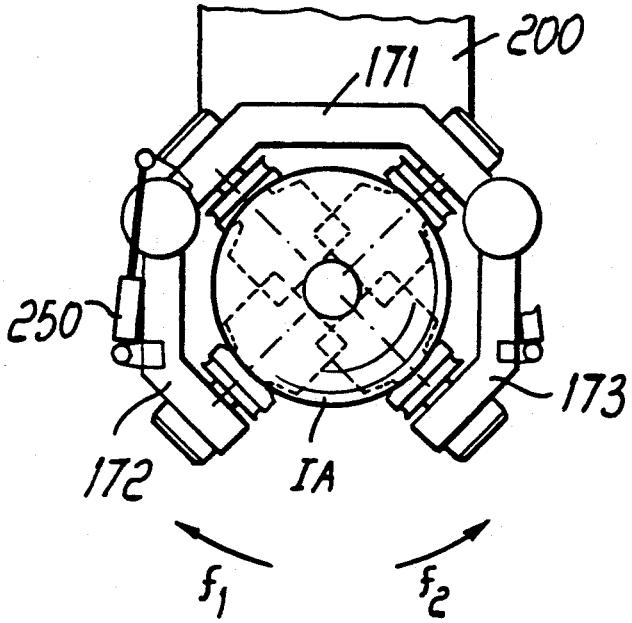
Figure 12:
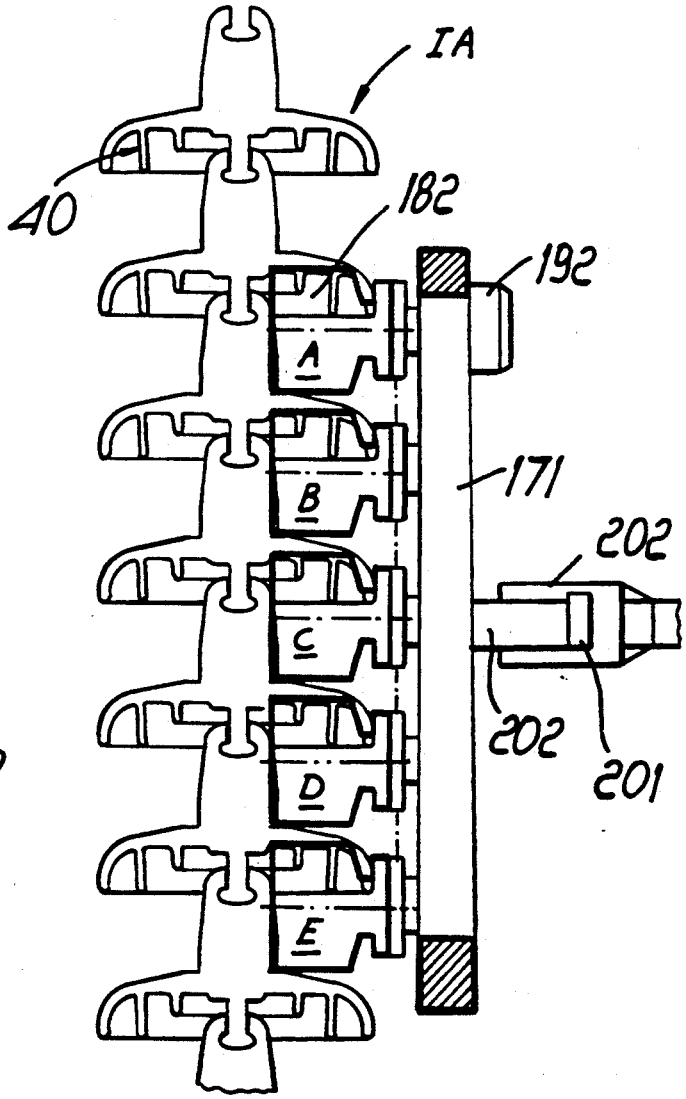
FIG. 12 is a schematic sectional view taken along the line XII—XII of FIG. 10.

The set of brushes is approached to each set of insulators, after orientating the arm 13, in order to arrange the axis of the brushes substantially parallel to the axis of the insulator set; the support 23 of the brush 20 is open as illustrated in FIG. 7.

After approach, the support 23 is closed so that the set of three brushes, which have meanwhile been rotationally actuated, embraces the set of insulators to clean them mechanically, possibly in the presence of substances nebulized by the nozzles 31, 32 and 33. The rotation of the brushes, by virtue of the inclination of the axes, also causes the movement of the apparatus along the axis of the set of insulators; said movement must be compensated by corresponding slight movements of the helicopter from which the apparatus is suspended.

A television camera (not illustrated), preferably arranged on the structure 11, is trained on the set of brushes and allows the operator to follow the operations of approach and subsequent separation of the apparatus from the insulator sets.

The structure 11, the arm 13 and the supporting forks 21, 22 and 23, as well as the shafts of the brushes, are made of electrically insulating material, in particular polymeric resin reinforced with glass fibers, in order to prevent the forming of discharge arcs when the apparatus operates on live lines.

In the variated embodiment of FIGS. 9 to 12, which is suitable for high-voltage lines with insulators IA which have an umbrella-shaped profile and are provided with protruding ridges 40, the cleaning head 170 comprises a supporting frame with a substantially polygonal plan which has a fixed portion 171, connected to the arm 13, and at least one movable portion, preferably two movable portions 172–173, articulated to the fixed portion along respective articulation axes "a" and "b". The supporting frame, which is made of reinforced polymeric material, extends, in the plane which is orthogonal to the drawing, for an extent of convenient length, for example for an extension equal to the extension of five adjacent insulators, comprised between 100 and 120 cm. Each of the fixed and movable parts of the frame supports, in a cantilever manner, a plurality of rotating brushes 180, 181, 182, 183 which extend perpendicularly from the frame at the point at which it is mounted, and therefore have their axis of rotation orthogonal to the axis of the set of insulators. The brushes are distributed on the fixed and movable portions of the frame in a plurality of adjacent rows A, B, . . . , E, for example five rows, and are suitable for penetrating, with their free end, in the spaces comprised between adjacent insulators; the rows of brushes are spaced by an extent which is equal to the spacing pitch of the insulators. Fluid-activated motors 190, 191, 192 and 193 actuate the mutually aligned brushes with the interposition of transmission means, preferably of the chain or toothed-belt type.

As clearly illustrated in the figures, the movable portions 172–173 of the frame can assume, by virtue of the action of jacks 250, an open position (FIGS. 9–10) for the approach of the head 170 to the set of insulators and a closed position (FIG. 11) which moves all the brushes of the head into contact engagement with the corresponding portion of said insulator set. The axial profile of the brushes can be cylindrical, conical or defined by a paraboloid generated by rotation, and is chosen according to the dimensions of the insulators.

In order to ensure in any case the complete coverage of the surface of the insulators by the brushes, the cleaning head 170 is preferably connected, in an oscillatable manner, to the arm 13 so as to be angularly oscillatable about the axis of the set of insulators. For this purpose, the fixed portion 171 of the polygonal frame of the head has a coupling plate 200 provided with at least one circular protruding ridge 201 which engages, for guiding and retention purposes, in a circular recess defined in a fork-like end 202 of the arm 13; the center of curvature of said recess coincides with the center of the polygonal perimeter of the frame 171–172. An actuator, not illustrated, is provided in order to move the plate 200 with respect to the end 202 of the arm along the arrows f1–f2 of FIG. 12.

In operative conditions, the head 170 is moved onto successive portions of the set of insulators, after opening and then closing the movable portions 171–172, until the entire set of insulators is fully cleaned; said movements are compensated by corresponding movements of the helicopter in order to keep the apparatus along the barycentric vertical line which passes through the suspension hook.

The details of execution and the embodiments may naturally be altered extensively, with respect to what has been described and illustrated by way of non-limitative example, without changing the concept of the invention and without thereby abandoning the scope of said invention.

In particular, the rotation of the brushes can be produced by electric motors rather than by fluid-activated ones, and a similar electric motor, preferably a step motor, can be provided, in replacement of the fluid-activated motor, to move the turret 15 which supports the arm 13 and to cause the oscillation of the head 170.

I claim:

1. Apparatus for cleaning the insulators of live power lines by means of helicopters, comprising:

an operating structure having an orientable arm, said operating structure being suspendable from a helicopter barycentric hook, said orientable arm having an end;

a cleaning head connected to said end of said orientable arm and comprising suspension support means;

rotatable cleaning brushes connected to said suspended support means;

motor means for actuating said rotatable cleaning brushes; wherein said suspension support means comprise;

fixed suspension support means including a frame rigidity connected to said orientable arm, and;

movable support means oscillatably supported by said frame and including controlled movement means, said movable support means being movable away from said frame, for locating an insulator to be cleaned between said frame and said movable support means, said movable support means being successively movable towards said frame for moving all of said rotatable cleaning brushes into embracing contact engagement with an insulator to be cleaned.

2. Apparatus according to claim 1, wherein said cleaning head comprises a set of at least three rotatable brushes having axes of rotation, wherein said frame comprises fixed forks, said fixed forks each having an end and supporting at least two of said rotatable brushes, and wherein said movable support means comprises a fork, said fork supporting at least one of said rotatable brushes and being rotationally coupled to said end of one of said fixed forks, whereby said brushes are locatable with said axes of rotation substantially parallel to an axis of an insulator to be cleaned.

3. Apparatus according to claim 1, wherein said cleaning head comprises a set of at least three rotatable brushes having axes of rotation, wherein said frame comprises fixed forks, said fixed forks each having an end and supporting at least two said rotatable brushes, wherein said movable support means comprises a fork, said fork supporting at least one of said rotatable brushes and being rotationally coupled to said end of one of said fixed forks, and, wherein said axes of rotation mutually converge in order to generate an axial thrust component which causes translatory motion of said operating structure when said brushes embrace an insulator.

4. Apparatus according to claim 3, wherein said axes of rotation are inclined by an angle between 4 and 8 degrees.

5. Apparatus according to claim 1, wherein said rotatable cleaning brushes comprise disk-like layers of bristles, said bristles being made of synthetic material, said disk-like layers being stacked for penetrating spaces between two contiguous insulators.

6. Apparatus according to claim 1, wherein said rotatable brushes are arranged in adjacent rows and each have an axis of rotation, said rotatable brushes being cantilevered to said cleaning head and each having a free end for penetrating spaces between adjacent insulators to be cleaned with said axis of rotation arranged orthogonally with respect to insulators to be cleaned.

7. Apparatus according to claim 1, wherein said frame comprise a supporting frame having a substantially polygonal configuration.

8. Apparatus according to claim 7, wherein said frame is articulated to said orientable arm, said apparatus further comprising actuation means for oscillating said cleaning head with respect to said orientable arm.

9. Apparatus according to claim 1, wherein said motor means for actuating said rotatable cleaning brushes comprise fluid-activated motors.

10. Apparatus according to claim 9, wherein said fluid-activated motors are connectable to an operating structure, said operating structure comprising a pressurized fluid source.

11. Apparatus according to claim 9, wherein said fluid-activated motors are connected to an operating structure, said operating structure comprising a pressurized fluid source, said pressurized fluid source being connected to said fluid-activated motors by flexible pipes and locatable aboard a helicopter.

12. Apparatus according to claim 9, wherein said fluid-activated motors are connected to an operating structure, said operating structure comprising a pressurized fluid source, said pressurized fluid source being connected to said fluid-activated motors by flexible pipes and locatable aboard a helicopter, wherein said pressurized fluid source comprises pressurized fluid bled from a helicopter engine compressor.

13. Apparatus according to claim 1, wherein said orientable arm is articulated to said operating structure by a rotational coupling, said rotational coupling comprising a base and a turret, said base being connected to said orientable arm and inclined by 45 degrees with respect to said operating structure, said turret being rotatably connected to said base and having a turret axis of rotation, said orientable arm being arranged at 45 degrees with respect to said turret axis of rotation.

14. Apparatus according to claim 13, further comprising a turret actuator, said turret actuator being adapted for rotating said turret with respect to said base.

15. Apparatus according to claim 1, wherein said operating structure, said orientable arm, and said suspension support means are made of electrically insulating material.

16. Apparatus according to claim 15, wherein said electrically insulating material comprises polymeric material reinforced with glass fibers.

17. Apparatus according to claim 15, wherein said electrically insulating material comprises polymeric material reinforced with carbon fibers.

18. Apparatus according to claim 15, wherein said electrically insulating material comprises polymeric material reinforced with glass and carbon fibers.

* * * * *